US005863144A

United States Patent [19]

Ackermann

[11] Patent Number: 5,863,144

[45] Date of Patent: Jan. 26, 1999

[54] SEALED LIPSTICK CONTAINER

[75] Inventor: Walter T. Ackermann, Watertown, Conn.

[73] Assignee: Risdon Corporation, Naugatuck, Conn.

[21] Appl. No.: 900,730

[22] Filed: Jul. 25, 1997

[51] Int. Cl.[6] ..... A45D 40/04

[52] U.S. Cl. ..... 401/78; 401/98

[58] Field of Search ..... 401/78, 98

[56] References Cited

U.S. PATENT DOCUMENTS

| | | | |
|---|---|---|---|
| 1,966,884 | 7/1934 | Coe | 401/78 |
| 2,222,415 | 11/1940 | Landwehr | 401/78 |
| 2,256,644 | 9/1941 | Houlihan | 401/78 X |
| 2,349,800 | 5/1944 | Lee | 401/98 |
| 3,091,329 | 5/1963 | Levine | 401/78 X |
| 4,603,989 | 8/1986 | Ackerman et al. | 401/98 X |
| 5,221,153 | 6/1993 | Spatz | 401/98 |
| 5,234,275 | 8/1993 | Gueret | 401/78 |
| 5,342,134 | 8/1994 | Lombardi et al. | 401/78 |

*Primary Examiner*—David J. Walczak
*Assistant Examiner*—Kathleen J. Prunner
*Attorney, Agent, or Firm*—Dallett Hoopes

[57] ABSTRACT

A lipstick container cover has a cup-shaped insert which sealingly telescopes over a sealed base assembly. The cover insert has an inward peripheral rib which makes line sealing contact with the sleeve. A bump formed on the sleeve raises the rib to vent pressure caused either by pushing the cover on the lipstick container or pressure build-up due to vaporizing solvent after the cover is fully installed. Venting the pressure in the container avoids the lifting off of the cover after installation. Otherwise such lifting unseals the container.

4 Claims, 3 Drawing Sheets

SEALED LIPSTICK CONTAINER

FIELD OF THE INVENTION

This invention relates to lipstick containers. More specifically, this invention relates to containers for lipstick pomade having volatile solvents and includes means for inhibiting the vaporization of the solvent. In short, the invention relates to sealed lipstick containers.

BACKGROUND OF THE INVENTION

The prior art is replete with disclosures of lipstick cartridges of the repel/propel-type wherein a cam within the container drives the pomade up as it is turned with respect to the base. Containers of this type have been used with pomades that remained moist and readily transferable from the pomade stick to the lips, because the formulations have generally been waxy and have withstood continuous exposure to the air.

However, fashion trends call for formulations that exhibit low transfer characteristics after being applied to the lips. As a result, the pomade must contain greater amounts of pigment suspended in highly volatile carriers, such as silicon-based solvents. Because the solvents are volatile, continued exposure to the air results in rapid evaporation and drying out of the pomades so that they produce an unsatisfactory application to the lips. In addition, the pomades shrink and become loose in the container.

For the above reason, there has been a need for a lipstick container including means to seal the pomade from the surrounding air.

In attempting to develop a sealed lipstick, an approach has been to contain the base with a cup-like sleeve and provide the usual inverted cup-shaped cover which contains an inverted cup-shaped plastic sealing insert adapted to telescope over the top of the sleeve. To achieve good sealing, an inward rib has been added about the inside of the mouth of the insert. Such a rib has made effective line contact about the sleeve.

The effectiveness of the seal has actually defeated the integrity of the system described because, when it engages the sleeve, it is so effective that the remaining travel of the cover to the "home" position on the container has resulted in compression of air in the cover/container assembly. Subsequently, when the lipstick has been allowed to rest in the owner's handbag, for instance, the compressed air has forced the cover off the container, resulting in no protection at all against the drying of the pomade. Also, high environmental temperatures can result in excessive solvent evaporation within the sealed container causing a pressure rise that forces the cover off the container. The above-described ejection of the cover is the action with which the present invention deals.

SUMMARY OF THE INVENTION

The invention relates generally to a sealed lipstick of the repel/propel type having a sleeve extending up from the base, the sleeve having a smooth peripheral surface portion, and a plastic inverted cup-shaped insert in the cover has adjacent its mouth an inward annular rib sealingly engaging the peripheral surface portion. In the invention the sleeve has a vent means positioned partway between the upper end of the sleeve and the final resting place of the rib when the cover is fully home, whereby as the rib passes the vent means in installation on the cover, any pressure built in the container is vented as the rib passes the vent means, and having vented the pressure, the cover will not be forced off by pressure buildup. The vent means may be a bump which raises the rib off the sleeve surface. It may also be a dimple or a simple hole. Likewise, after closure, any excessive pressure rise will cause the cover to rise, again forcing the insert bead to start sliding over the vent, thus relieving the pressure.

BRIEF DESCRIPTION OF THE DRAWINGS

Further objects and features of the invention will be apparent to those skilled in the art from a study of the following specification and the accompanying drawings, all of which disclose a non-limiting embodiment of the invention. In the drawings.

DESCRIPTION OF THE PREFERRED EMBODIMENT

Figure 1:
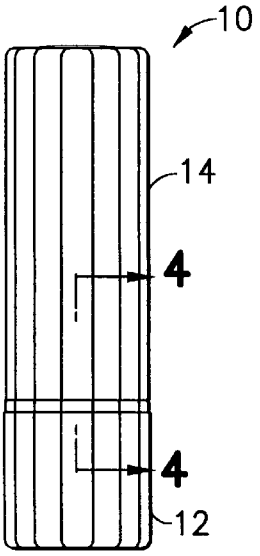
FIG. 1 is a side elevational view of a lipstick container embodying the invention.
Figure 1A:
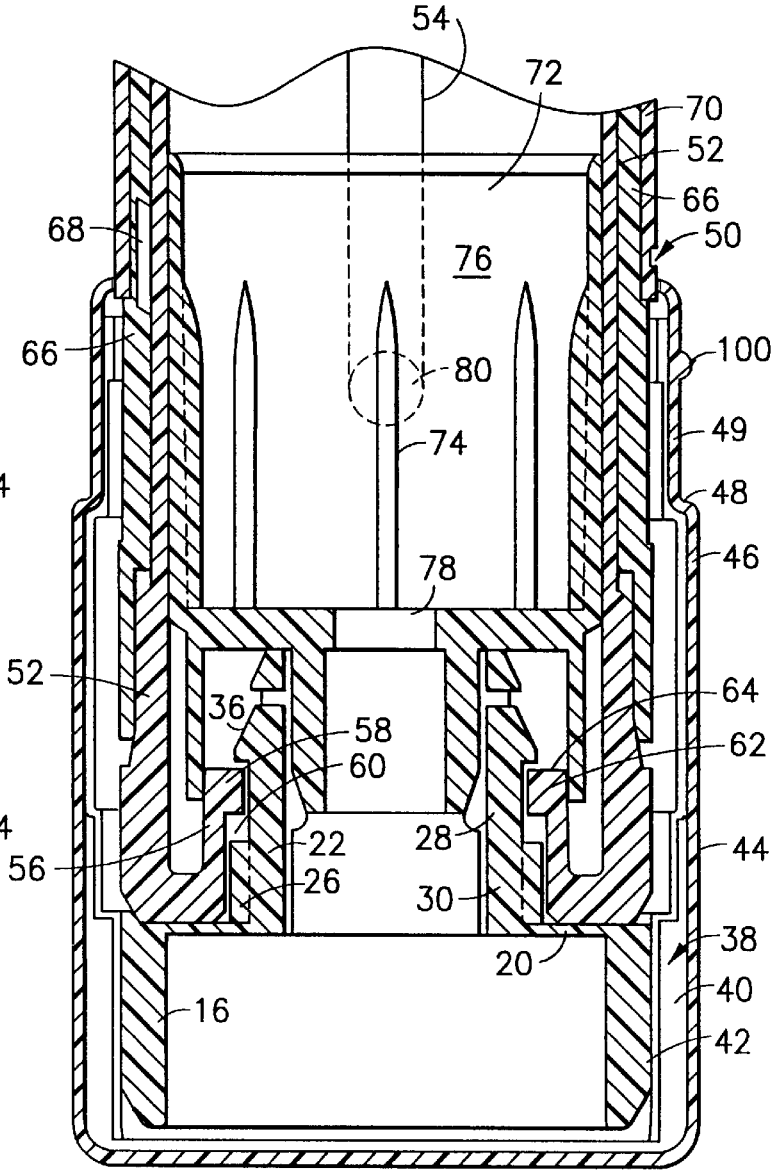
FIG. 1A is an enlarged fragmentary sectional view along the centerline of the container.
Figure 3:
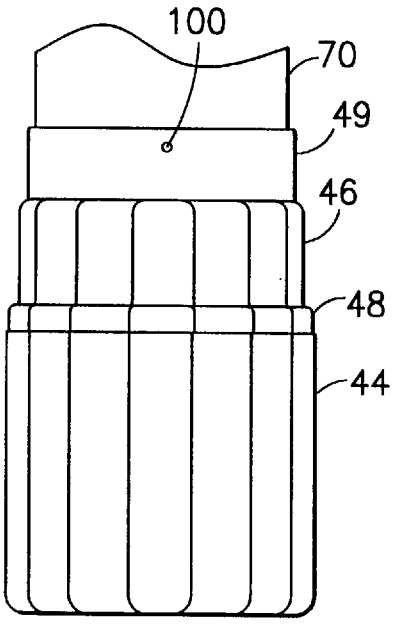
FIG. 3 is an enlarged fragmentary side elevation with the cover removed.

A lipstick embodying the invention is shown in FIG. 1 and generally designated 10. The internal structure shown in FIG. 1A is only illustrative of a lipstick container structure which may embody the invention. An example is shown in U.S. Pat. No. 5,599,124 assigned to my assignee. The internal structure may comprise virtually any repel/propel screw-driven lipstick container.

The structure shown comprises a base assembly 12 and a cover 14. The base assembly (FIG. 1A) comprises a plastic plug 16 having a generally round bottom portion, an inward transverse wall 20 and a central upward tubular core 22. Adjacent the wall 20 the tubular core is formed with vertical spaced ridges 26. As best shown in FIG. 1*a*, above the ridges 26 the tubular core 22 is formed with cantilevered spring latches 28. These latches are integral with the core at their lower ends 30 and are each formed with outward hooks 36 which provide a latching function, the hooks having downwardly and outwardly inclined upper ends (FIG. 1A).

The base plug 16 is surrounded by an upward sleeve 38. The lower end of the sleeve 38 has a reduced inward portion 40 and is cemented to the peripheral wall 42 of the plug. A fluted base 44 is secured to the outside of the sleeve 38 and a collar 46 having an inward shoulder 48 sits on the top of the base. The smooth upper peripheral portion 49 of the sleeve 38 is exposed above the collar 46.

Figure 2:
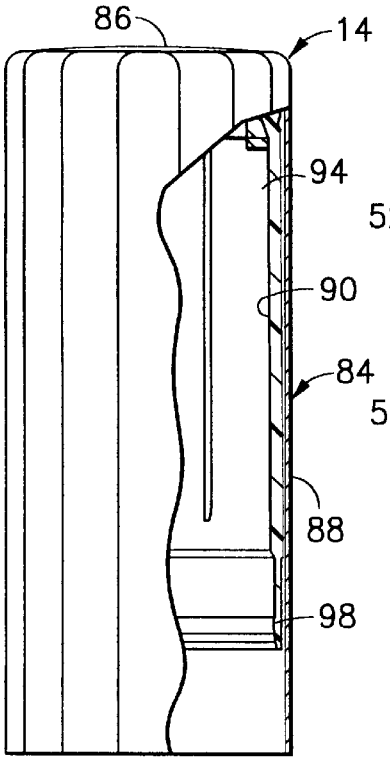
FIG. 2 is an enlarged side elevation of the cover partly broken away to show the plastic insert.

The lipstick also comprises a cartridge generally designated 50 (FIG. 1A). The cartridge includes a tubular innerbody 52 having longitudinal slots 54 as is conventional. It is formed at its lower end with a tubular re-entrant portion 56 having at its mouth 58 inward spaced ribs 60 (FIG. 2) which interfit with the spaced ridges 26 so that the base assembly 12 and innerbody 52 turn in unison. The upper end 62 of the re-entrant portion 56 is enlarged and presents an annular upwardly facing shoulder 64.

Closely surrounding the slotted tubular innerbody is the cam 66 which has a spiral track 68 as is conventional. A metal decorative shell 70 snugly encloses the cam 66 so as to be turnable therewith. A pomade cup 72, slidable inside the innerbody, may be formed with inward vertical ribs 74 to enhance the security of the pomade (not shown) in the cup. The pomade cup 72 includes the downward outer annular wall 76 which extends down to help guide the descending pomade cup 72 as the wall 76 telescopes over the re-entrant portion 56 at the bottom of its travel. The cup is formed with a central opening 78 for reasons well known.

The cup further comprises the outward lug 80 (shown dotted in FIG. 1A) which is received in assembly of the cartridge 50 through the slot 54 of the innerbody 52 and terminates in the spiral track 68 of the cam 66. Thus, as is conventional, when the base assembly 12 is turned relative to the shell 70, the pomade cup 72 is extended or retracted.

The sealing means including the vent means will now be described. As shown in FIG. 1A, the lipstick container of the invention includes a cover 14. The cover 14 (FIG. 2) may comprise an inverted-cup-shaped element 84 having a top wall 86 and a continuous cylindrical sidewall 88 fluted to match the base 44. Disposed inside the cover is a plastic sealing insert 90. Preferably, the insert is molded in resilient plastic resins that are impermeable to the pomade solvent vapors. The insert 90 is also inverted-cup-shape and its top wall (not shown) may be cemented or otherwise secured to the underside of the top wall 86 of the cover. The insert side wall 94 is formed with a reduced thickness portion 96 to snugly receive the smooth peripheral portion 49 of the sleeve 38.

Figure 4:
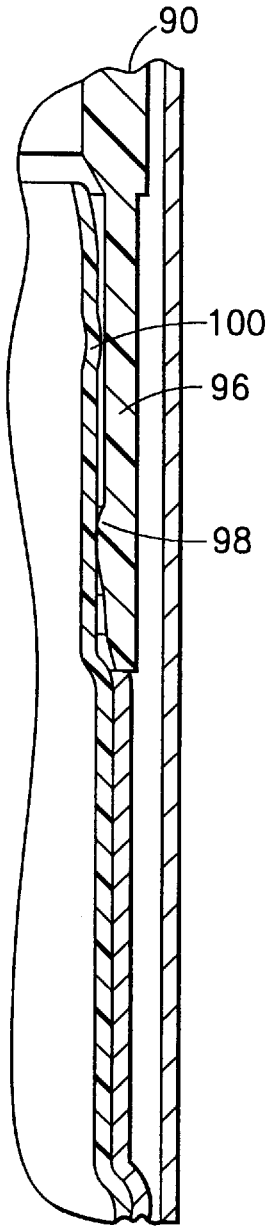
FIG. 4 is a greatly enlarged fragmentary sectional view taken on the line 4—4 of FIG. 1 with the cover in "home" position.

As shown in FIG. 4, the lower end of the plastic insert is also formed with an inward sealing rib 98. The rib 98 engages the smooth peripheral portion 49 of the sleeve in a line contact around the periphery of the sleeve.

As stated, in the past, the installation of a sealing cover 14 on the container 10 has been followed by the tendency of the cover to lift off the base. This has been caused by the force of air trapped inside the container and compressed as the cover is pushed on. As explained above, this ejection of the cover is not immediate. The delay will often mean that the lifting is not noticed until well after the installation.

Figure 5:
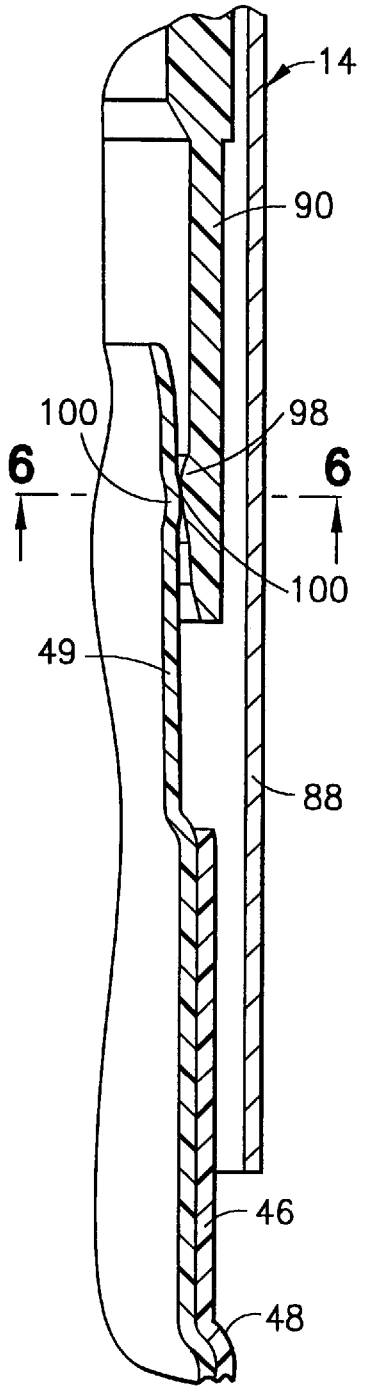
FIG. 5 is a view similar to FIG. 4 but showing the cover in venting position.
Figure 6:
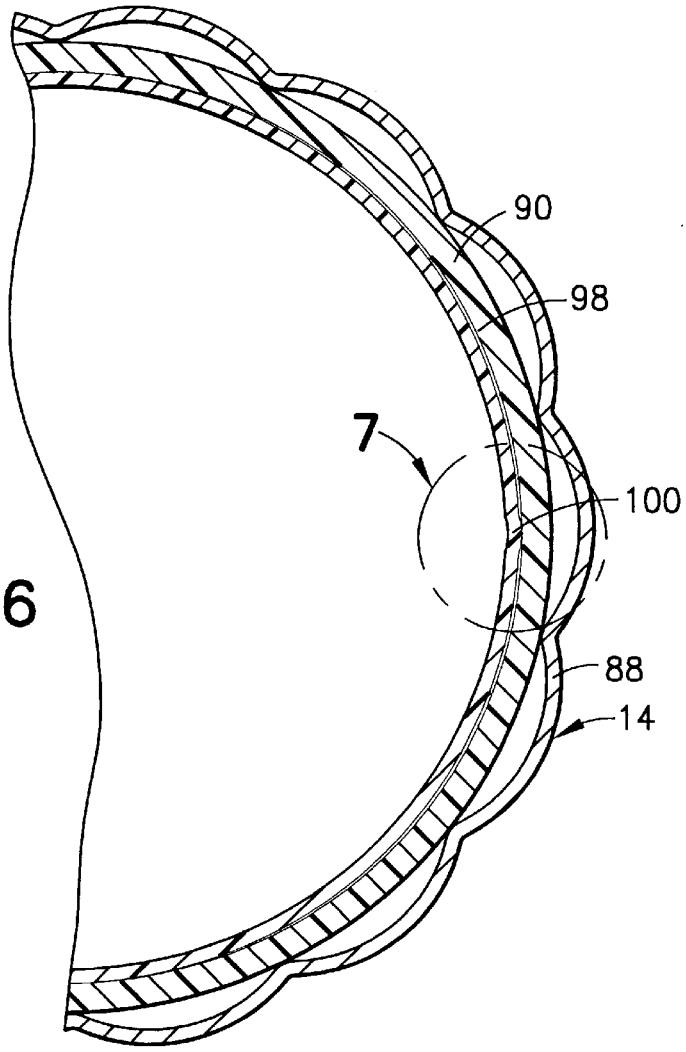
FIG. 6 is a sectional view taken on the line 6—6 of FIG. 5.
Figure 7:
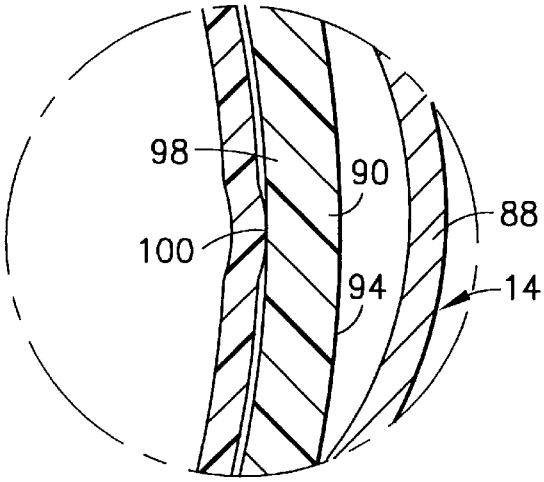
FIG. 7 is an enlarged view of the encircled portion of FIG. 6.

To deal with this phenomenon, the present invention provides vent means. As shown best in FIGS. 5, 6 and 7 in the best mode of practicing the invention, the smooth peripheral portion 49 of the sleeve 38 is formed with an outward bump 100. The effect is that as the rib encounters the bump while the cover is pushed home, the bump 100 raises the rib 98 off the adjacent areas of the smooth periphery portion 49 of the sleeve 38 so that pressure is vented through the crack made between the sleeve 38 and the rib 98 in the raised area.

From the venting position just described, the cover may be readily pushed to home position at which the cover engages the shoulder 48 on the collar 46. The bump 100 is positioned so that the installation is partly complete at the venting position and that any air compression in the subsequent part of the installation will be inconsequential.

The vent means of the invention also deals with the subsequent build-up of pressure due to the solvent vaporizing after the cover is fully installed. Such pressure, if consequential, will pressure the cover to back off to the point where the rib engages the bump, and there will be a venting, a venting which will stop the backing off of the cover and the cover will stay installed on the lipstick container.

In actual practice it has been found that the bump 100 can be as little as 0.004 inch high and still be effective. The bump should not be so high as to interfere with the assembly or use of the lipstick. For symmetry, two bumps may be formed diametrically opposite on the portion 49 of the sleeve 38. It is strongly preferable that the bump have a pronounced shape in the plane radial to the axis of the container so that the insert does not conform to the shape as it passes over it. It can be gradual in plane longitudinal of the container axis to allow smooth action, or it can be pronounced to create a "snap" action which helps to retain the cover.

Figure 8:
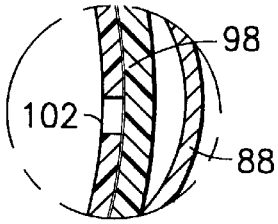
FIGS. 8 and 9 are views similar to the encircled portion of FIG. 6 showing modified forms of vent means under the invention.
Figure 9:
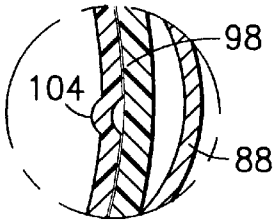

The form of the vent means may be other than that so far disclosed and still have the benefits of the invention. Aside from the bump 100, the vent means may also be a hole 102 (FIG. 8) or a dimple 104 (FIG. 9). In either case, the rib 98 passes over a depression in the sleeve so that there is a space created under the rib and pressure can vent out to achieve the effect sought. While the hole or dimple type vent means do work, the bump is preferred.

The invention is not limited to the embodiment disclosed but is of a scope defined by the following claim language which may be broadened by an extension of the right to exclude others from making, using or selling the invention as is appropriate under the doctrine of equivalents.

What is claimed is:

1. In a sealed lipstick container comprising:

a. a tubular innerbody formed with a longitudinal slot and having an enlarged base end, the base end having an upper end b. a pomade cup riding in the tubular innerbody and having a lug extending through the slot, c. a tubular cam surrounding the innerbody and having a spiral track formed therein, the track receiving the lug of the cup for advancing or repelling the cup as the cam is turned relative to the base end, d. a sleeve having a peripheral surface and sealingly surrounding the base end and extending upward therefrom, e. an inverted-cup-shaped cover telescoping over the sleeve and having a plastic inverted-cup-shaped insert having a mouth, the insert having adjacent the mouth an inward annular rib sealingly engaging the peripheral surface, the rib having a home position on the sleeve when the cover is fully installed over the sleeve, the improvement wherein the sleeve has vent means positioned partway between the upper end of the base end and the home position whereby as the rib during installation of the cover reaches the vent means, any pressure built up in the container is vented, and pressure built up as the rib moves from the vent means to home position will not result in dislodgement of the cover, but only movement of the rib toward the vent means to vent the pressure, and having vented the pressure, the cover will not be forced off by pressure buildup.

2. A lipstick container as claimed in claim 1 wherein the vent means comprises a bump, raised on the sleeve.

3. A lipstick container as claimed in claim 1 wherein the vent means is a depression in the sleeve.

4. A lipstick container as claimed in claim 1 wherein the vent means is an aperture in the sleeve.

* * * * *